United States Patent [19]

Wilks

[11] 4,404,047

[45] Sep. 13, 1983

[54] PROCESS FOR THE IMPROVED HEAT TREATMENT OF STEELS USING DIRECT ELECTRICAL RESISTANCE HEATING

[75] Inventor: Gerald W. Wilks, Calumet City, Ill.

[73] Assignee: LaSalle Steel Company, Chicago, Ill.

[21] Appl. No.: 214,878

[22] Filed: Dec. 10, 1980

[51] Int. Cl.[3] ..... C21D 1/40

[52] U.S. Cl. ..... 148/131; 148/150; 148/154

[58] Field of Search ..... 148/12 B, 150, 154, 148/131, 12.3, 12.4; 266/128, 131

[56] References Cited

U.S. PATENT DOCUMENTS

| | | | |
|---|---|---|---|
| 3,532,560 | 10/1970 | Tomioka et al. | 148/12 B |
| 3,699,797 | 10/1972 | Tournoy | 148/12 B |
| 3,847,002 | 11/1974 | Suzuki et al. | 148/12 B |
| 3,929,524 | 12/1975 | Filatov et al. | 148/154 |
| 4,252,578 | 2/1981 | Dumont et al. | 148/131 |
| 4,321,098 | 3/1982 | Hayden | 148/131 |

FOREIGN PATENT DOCUMENTS

| | | | |
|---|---|---|---|
| 679634 | 8/1979 | U.S.S.R. | 148/150 |
| 763477 | 9/1980 | U.S.S.R. | 148/131 |

*Primary Examiner*—Peter K. Skiff

*Attorney, Agent, or Firm*—Fitch, Even, Tabin & Flannery

[57] ABSTRACT

A process for the energy efficient heat treatment of steels wherein a steel workpiece is rapidly heated to a temperature above the $A_3$ temperature of the steel to convert the steel to austenite, the workpiece is then rapidly quenched in a liquid quench medium to convert the austenite to a predominantly martensitic microstructure, and the steel is then tempered by rapid heating while the workpiece is under tension, the tempering serving to convert the steel to a tempered martensitic form. The present invention virtually eliminates the problem of quench cracking and minimizes quench distortion as well as providing a finished product with improved uniformity, improved surface quality, and improved mechanical properties.

7 Claims, 19 Drawing Figures

ELONGATION VS. TENSILE STRENGTH – HEAT G

LARGE WORKPIECE PROCESSING UNIT

SMALL WORKPIECE PROCESSING UNIT

FURNACE TREATED 4150
AS-QUENCHED SPECIMENS
HEAT A

ELECTRICALLY TREATED 4150
AS-QUENCHED SPECIMENS
HEAT A

FURNACE TREATED 4150
AS-QUENCHED SPECIMENS
HEAT H
MAGNIFICATION - 4X

ELECTRICALLY TREATED 4150
AS-QUENCHED SPECIMEN
HEAT H
MAGNIFICATION - 4X

FURNACE TREATED 6150
AS-QUENCHED SPECIMENS
HEAT B

ELECTRICALLY TREATED 6150
AS-QUENCHED SPECIMENS
HEAT B

FURNACE TREATED 6150
AS-QUENCHED SPECIMEN
HEAT B
MAGNIFICATION - 4X

ELECTRICALLY TREATED 6150
AS-QUENCHED SPECIMEN
HEAT B
MAGNIFICATION - 4X

MECHANICAL PROPERTIES OF TEN HEATS OF 414X STEEL

MECHANICAL PROPERTIES OF VARIOUS MEDIUM CARBON STEELS

ELONGATION VS. TENSILE STRENGTH – HEAT G

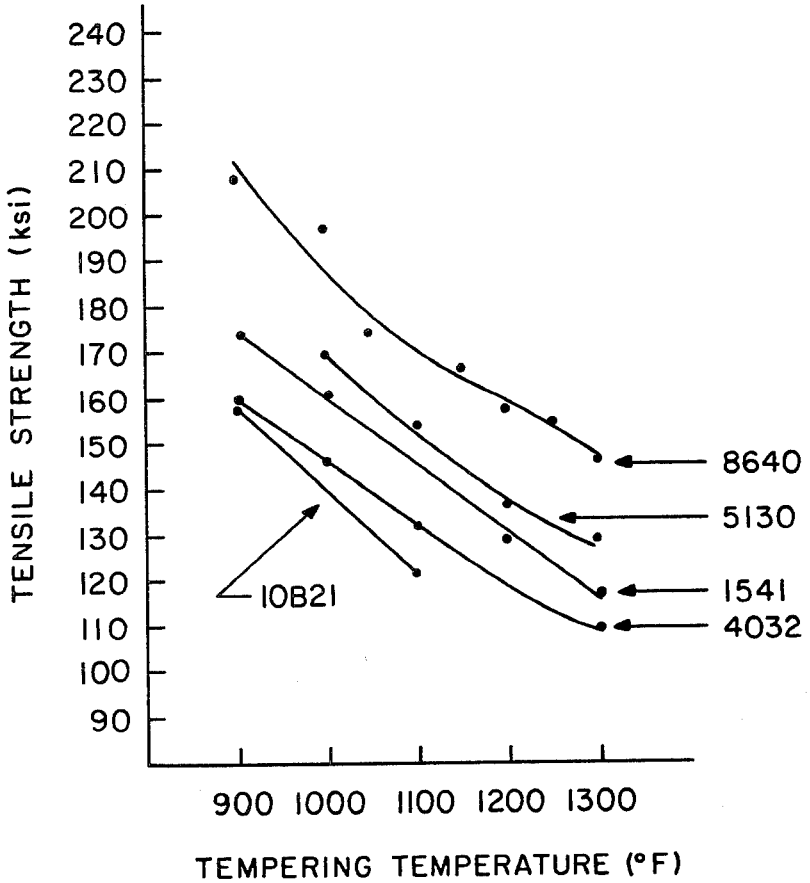
MECHANICAL PROPERTIES OF ADDITIONAL STEELS
FIG. 9
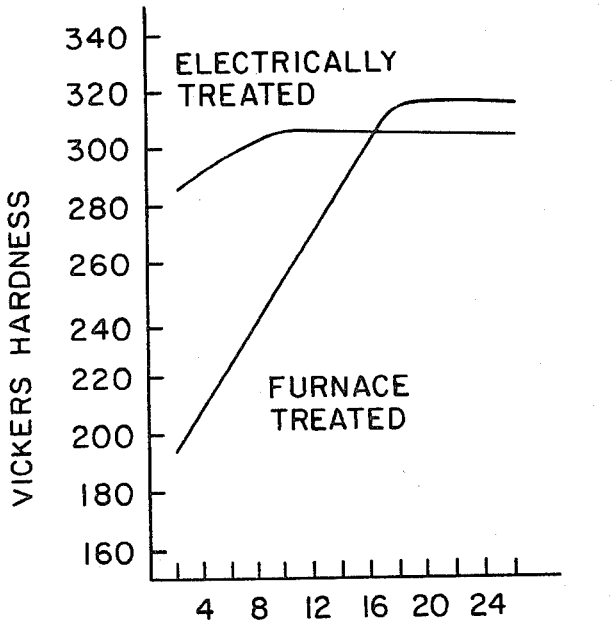
FIG. 13 HARDNESS VS. DEPTH

AS-QUENCHED BARS
HEAT J

TEMPERED BARS
HEAT J

FURNACE TREATED 4142
QUENCHED AND TEMPERED
SPECIMEN
HEAT V
100X NITAL ETCHED
DECARBURIZATION SHOWN

ELECTRICALLY TREATED STEEL
QUENCHED AND TEMPERED
SPECIMEN
HEAT A
100X NITAL ETCHED
LACK OF DECARBURIZATION
SHOWN

PROCESS FOR THE IMPROVED HEAT TREATMENT OF STEELS USING DIRECT ELECTRICAL RESISTANCE HEATING

This invention relates to the heat treatment of steels and more particularly to a process of austenitizing, quenching and tempering of steels to improve strength and toughness.

Austenitizing, quenching and tempering is a well-known heat treatment process for steels. Such processing is used primarily to strengthen and toughen steels so that they can be used for parts which are severely stressed in service. In general, the austenitizing step is carried out by heating the steel in a furnace maintained at a temperature above the $A_3$ temperature. The steel is held in the furnace for a time sufficient to insure that the entire furnace load is fully austenitized.

After the steel has been fully austenitized, it is quenched in water, oil, molten salt, or some other appropriate medium so that a predominantly martensitic structure forms in the steel. Frequently, during the quenching step, cracks form in the steel due to transformation and thermal stresses generated by the quenching action. That phenomenon is referred to as "quench cracking". Quench cracking thus is a deleterious effect of conventional heat treatment because it is unpredictable in nature and costly. To reduce quench cracking, it is frequently necessary to use a milder quenching medium such as oil instead of water. The use of a milder quenching medium means that the full hardening potential of a given alloy will not be realized. Despite the use of this precaution, quench cracking still occurs frequently.

Another undesirable phenomenon associated with the quenching step in conventional heat treatment is distortion of the workpiece. Thermal and transformation stress induced by the quench cause the workpiece to distort or change shape. That problem is particularly severe for long bars, rods, or tubes where this distortion is frequently in the form of a bend or bow in the workpiece. Bent workpieces are difficult to handle through subsequent processing steps, and ultimately the workpiece must be straightened. The conventional approach to minimizing the effects of quenching distortion is to use a milder quenching medium.

After the steel has been quenched, it is generally too hard and brittle to be commercially useful. Consequently, it must be tempered to produce a product with the desired combination of mechanical properties. Tempering is usually carried out in large furnaces which are maintained at temperatures below the $A_1$ temperature. The workpieces are loaded into a furnace and held there until the entire furnace load reaches the desired temperature. Then they are removed and allowed to cool. The exact tempering temperature selected depends upon the mechanical properties desired in the finished workpiece. In general, the strength of the steel decreases with increasing tempering temperature while the ductility and toughness of the steel improve with increasing tempering temperature.

Once the steel has been austenitized, quenched and tempered using conventional techniques, it must be further processed to remove the undesirable effects of heat treatment including: the oxide that has formed on the surface of the steel, decarburization of the surface of the steel, and quenching distortion. During the austenitizing step in the heat treatment, the steel is exposed to high temperatures for a long period of time. Frequently, this causes carbon to react with the furnace atmosphere and results in the depletion of carbon from the surface of the steel. This carbon-depleted zone is referred to as the "decarburized layer", and must often be removed from the steel surface before the workpiece can be made into a useful part. Usually, grinding or turning are used to remove the decarburized surface layer, and these processes are quite expensive.

Another problem associated with conventional heat treatment is the information of oxide on the surface of the steel. Once the surface of the steel has been decarburized, an oxide scale forms on the steel, This oxide scale is generally quite hard and abrasive and must be removed from the steel before any subsequent processing steps are undertaken. Oxide scale can be removed by either mechanical or chemical means, but, in either case, additional costs are incurred. A protective atmosphere can be used to avoid the problem of scale formation, but the costs of protective atmospheres are high.

Finally, any quenching distortion that has occurred during heat treatment must be corrected before the workpiece can be made into a useful part. for long workpieces, such as bars, rods, tubes, etc., the normal corrective measure is mechanical straightening. Small parts must be ground or machined to the desired finished size to compensate for quenching distortion. In either case, the cost of correcting quenching distortion is relatively high.

The prior art has, as noted, carried out heat treatment processes using large furnaces. Just the size of these furnaces in terms of floor space, and the capital investment required, represents a significant drawback to their use. As is well known to those skilled in the art, there are several further disadvantages associated with the use of conventional heat treatment furnaces. In the first place, furnace heating efficiency is generally quite low, with the result that increasing fuel costs make it desirable to provide a more efficient means of heating steel. In addition, furnace heating takes place by radiation, conduction and convection, thus necessitating long cycles to insure that the entire load of steel in the furnace has been subjected to uniform processing in a given heating cycle. Such long cycles are themselves disadvantageous, for the elevated temperatures used require the use of a known nonoxidizing atmosphere (i.e., a protective atmosphere or vacuum), which requires additional energy to produce. The alternative is to allow the workpieces to oxidize during processing and then clean the workpieces after the thermal treatment.

An additional disadvantage of furnace heating is related to the control over the temperature of the load within the furnace. Directly monitoring the temperature of the furnace load is difficult, and usually thermocouples are used to monitor the temperature of the furnace rather than the temperature of the load itself. Also, the temperature on the outside of the furnace load is typically different from that in the core of the load. Consequently, long "soak" times are employed to minimize this difference. The result of the lack of control over temperature of the furnace load during furnace heating is that the load is not uniformly heated during either the austenitizing or tempering steps of the heat treatment. This lack of control contributes to poor product uniformity.

It has been proposed, as described in U.S. Pat. Nos. 3,908,431, 4,040,872, and 4,088,511 to treat steels using various thermal cycles by the use of direct electric resistance heating techniques. Those techniques have the advantage of providing very rapid heating of steel workpieces with high efficiencies, including uniform heating over the entire cross section of the workpiece. An additional advantage is that the temperature of each workpiece can be easily monitored so that a very uniform product can be produced.

Direct electric resistance heating has been used in a somewhat similar heat treating process as described in U.S. Pat. No. 4,040,872. In that process, a carbon steel is rapidly heated by direct electric resistance heating to a temperature above the $A_3$ temperature and quenched to produce a microstructure with unique properties. This microstructure consists of a mixture of acicular pro-eutectoid ferrite and a finely divided aggregate of ferrite and iron carbide. This process avoids quenching the steel to form a fully martensitic structure.

It is accordingly an object of the present invention to provide an improved process for the austenitizing, quenching and tempering of steels.

It is a more specific object of the present invention to provide an improved process for the heat treatment of steels which substantially eliminates the problem of quench cracking, minimizes the problem of quenching, distortion, prevents a significant amount of decarburization of the steel during heat treatment, and mimimizes the amount of oxide scale which forms on the steel surface, all while making it possible to realize the full hardening potential of the steel.

It is yet another object of this invention to provide steels which have a high degree of uniformity as well as improved ductility, toughness, and fatigue strength.

FIG. 9 is a graph of tensile strength versus tempering temperature for additional medium carbon steels which were processed in accordance with the concepts of this invention.

FIG. 13 is a graph of Vickers' hardness versus the depth beneath the surface for two heat treated specimens.

Figure 1:
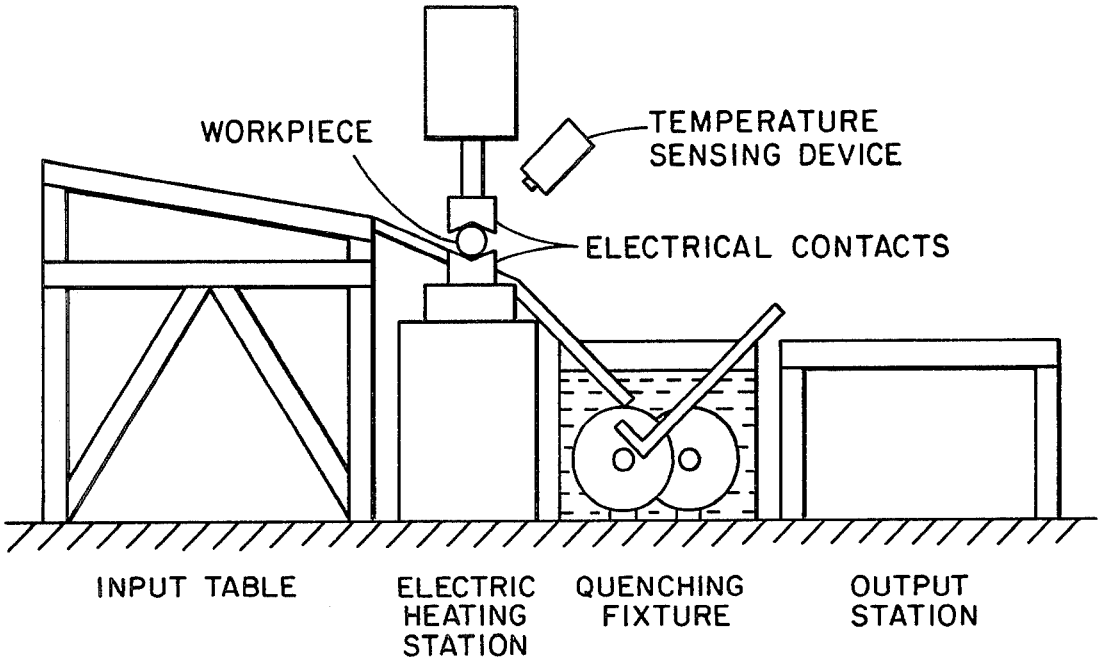
FIG. 1 is a schematic illustration of the equipment used for heat treating elongated workpieces in accordance with the concepts of this invention.

The concepts of the present invention reside in the discovery that many of the problems associated with conventional heat treatment of austenitization, quenching and tempering can be eliminated or significantly reduced through the use of rapid heating. It has been discovered that quench cracking can be virtually eliminated if rapid austenitization is employed. Furthermore, rapid austenitization using direct electric resistance heating has been found to significantly reduce quenching distortion. Rapid austenitization also reduces the amount of oxide that forms on the surface of the steel during heat treatment, and minimizes the decarburization of the steel. Finally, it has been discovered that any quenching distortion that does occur can be virtually eliminated through the application of the appropriate stresses during the tempering step in the heat treatment.

In accordance with the practice of the present invention, a steel workpiece of repeating cross section is subjected to the steps of rapidly heating, to a temperature above the $A_3$ temperature for the steel, to convert the steel to austenite. Thereafter, the steel workpiece is rapidly quenched in a liquid quench medium to convert the austenite thus formed to a predominantly martensitic microstructure. In that condition, the workpiece is highly stressed. In the last step, the steel is tempered by subjecting the workpiece to tension while rapidly heating it to a temperature below the $A_1$ temperature of the steel whereby the steel is converted to a tempered martensitic microstructure.

Without limiting the present invention as to theory, it is believed that the rapid austenitizing cycle employed by the present invention virtually eliminates the problem of quench cracking because there is insufficient time during the short austenitizing cycle for embrittling elements to diffuse to the austenite grain boundaries and cause grain boundary embrittlement. It is well known that quench cracking is a grain boundary phenomenon. When conventional furnace austenitizing treatments are used, the furnace load is exposed to temperatures above the $A_1$ temperature for long periods of time to insure that the entire furnace load has reached the appropriate temperature prior to quenching. Consequently, there is sufficient time for various elements to diffuse to the austenite grain boundaries and remain segregated there. Known embrittling elements such as sulfur, phosphorus, tin, and antimony have been found to segregate at austenite grain boundaries during conventional furnace austenitizing treatments. Furthermore, other elements such as chromium, nickel, and manganese also segregate at the austenite grain boundaries, and these elements may influence quench cracking as well.

Direct electric resistance heating makes it possible to heat the steel very rapidly, and the time above the $A_1$ temperature is insufficient to permit a significant amount of grain boundary segregation to occur. Hence, the grain boundaries remain strong, and cracking during the quench is virtually eliminated.

It is also believed that direct electric resistance heating makes it possible to reduce the level of distortion in the workpieces which occurs as a result of conventional heat treatment. When steel is heated in a furnace, the heating is non-uniform because the heat must penetrate the furnace load from the furnace environment. As a result of this non-uniform heating, thermal stresses are developed in the workpieces which may cause distortion. Furthermore, the furnace load may sag under its own weight distorting the workpieces. Also, the mass of the furnace load may prevent some workpieces from expanding freely as they are heated, and this may cause additional distortion. As a result of these phenomena, the workpieces are somewhat deformed when they are removed from the furnace, and during the quench, that distortion is enhanced.

When direct electric resistance heating is used instead of furnace heating, the distortion of the workpiece can be minimized. During direct electric resistance heating, the workpiece can be held in tension to allow free expansion and well supported along its length to prevent sagging. Since only one workpiece is heated at a time, the weight of other workpieces does not contribute to distortion. Furthermore, direct electric resistance heating is uniform both across the cross section and along the length of the workpiece. Consequently, thermal stresses are small and distortion due to thermal stress is eliminated. Since the austenitized workpiece is delivered to the quenching media with minimum distortion, less distortion occurs during quenching. Hence, direct electric resistance heating makes it possible to minimize the distortion that occurs during the austenitizing and quenching of steel workpieces.

Yet another advantage of using direct electric resistance heating is that any distortion that does occur during the austenitizing and quenching steps of the process can be significantly reduced during the tempering step. It has been discovered that the level of distortion in elongated workpieces can actually be reduced during tempering if the workpiece is held in tension during the entire heating process. The tension stress required to cause straightening is far below the yield stress of the steel. This process of straightening during the tempering cycle was named "temper straightening," and it is believed to be caused by the preferential redistribution of residual stresses in the steel during the early stages of tempering.

In addition to eliminating many of the problems associated with conventional heat treatment, the present invention also provides for improved quality in the heat treated steel. Tests have revealed that the products produced in accordance with the concepts of this invention have improved uniformity as compared to products produced by conventional means. Improvements in ductility, toughness, and fatigue strength have also been observed.

Representative steels which can be used in accordance with the concepts of the present invention are shown in the following table:

TABLE I

CHEMICAL ANALYSIS OF COMMERCIAL STEELS

| Heat | Grade | Diameter (in.) | C (%) | Mn (%) | P (%) | S (%) | Si (%) | Ni (%) | Cr (%) | Mo (%) | Cu (%) | Al (%) | Other (%) |
|---|---|---|---|---|---|---|---|---|---|---|---|---|---|
| A | 4150 | 1.026 | 0.51 | 1.05 | 0.008 | 0.031 | 0.26 | 0.05 | 0.84 | 0.18 | 0.07 | 0.029 | Te-0.045 |
| B | 6150 | 1.066 | 0.50 | 0.80 | 0.007 | 0.023 | 0.28 | 0.17 | 0.93 | 0.06 | 0.10 | 0.015 | V-0.12 |
| C | 4142 | 0.593 | 0.39 | 0.85 | 0.007 | 0.022 | 0.24 | 0.02 | 0.86 | 0.17 | 0.01 | 0.043 | Se-0.025 |
| D | 4142 | 0.991 | 0.41 | 0.93 | 0.014 | 0.039 | 0.27 | 0.17 | 0.98 | 0.15 | 0.03 | 0.027 | Te-0.045 |
| E | 4140 | 0.996 | 0.39 | 0.90 | 0.007 | 0.010 | 0.40 | 0.14 | 1.07 | 0.17 | 0.01 | 0.010 | |
| F | 41L40 | 1.063 | 0.42 | 0.92 | 0.010 | 0.026 | 0.23 | 0.16 | 0.97 | 0.16 | 0.11 | 0.026 | Pb-0.19 |
| G | 4140 | 1.125 | 0.42 | 0.96 | 0.010 | 0.020 | 0.29 | 0.20 | 1.09 | 0.18 | 0.13 | 0.029 | |
| H | 4145 | 1.688 | 0.46 | 0.78 | 0.010 | 0.029 | 0.29 | 0.12 | 0.92 | 0.16 | 0.11 | 0.035 | Te-0.042 |
| I | 4140 | 2.000 | 0.40 | 0.91 | 0.007 | 0.021 | 0.22 | 0.21 | 0.95 | 0.17 | 0.12 | 0.020 | |
| J | 4142 | 2.070 | 0.44 | 1.01 | 0.009 | 0.024 | 0.28 | 0.02 | 0.99 | 0.19 | 0.02 | 0.058 | Se-0.031 |
| K | 4142 | 2.438 | 0.41 | 0.89 | 0.012 | 0.023 | 0.26 | 0.02 | 0.90 | 0.19 | 0.02 | 0.041 | Se-0.033 |
| L | 4145 | 3.500 | 0.46 | 0.97 | 0.009 | 0.022 | 0.22 | 0.05 | 1.07 | 0.20 | 0.03 | 0.042 | Se-0.039 |
| M | 4340 | 1.315 | 0.40 | 0.72 | 0.010 | 0.022 | 0.18 | 1.73 | 0.85 | 0.20 | 0.14 | 0.023 | |
| N | 1144 | 0.625 | 0.44 | 1.66 | 0.005 | 0.264 | 0.19 | 0.01 | 0.05 | 0.01 | 0.14 | 0.000 | |
| O | 1045 | 0.750 | 0.44 | 0.82 | 0.015 | 0.011 | 0.17 | 0.02 | 0.03 | 0.01 | 0.01 | 0.025 | |
| P | 8640 | 1.063 | 0.41 | 1.03 | 0.009 | 0.036 | 0.28 | 0.46 | 0.59 | 0.18 | 0.04 | 0.038 | |
| Q | 5130 | 0.875 | 0.32 | 0.98 | 0.007 | 0.034 | 0.31 | 0.09 | 0.83 | 0.02 | 0.04 | 0.020 | |
| R | 1541 | 1.031 | 0.39 | 1.39 | 0.015 | 0.011 | 0.16 | 0.02 | 0.02 | 0.01 | 0.01 | 0.026 | |
| S | 4032 | 0.890 | 0.33 | 0.77 | 0.010 | 0.012 | 0.21 | 0.20 | 0.13 | 0.23 | 0.01 | 0.050 | |
| T | 10B21 | 1.062 | 0.21 | 0.98 | 0.011 | 0.017 | 0.28 | 0.02 | 0.24 | 0.01 | 0.04 | 0.031 | B-0.0029 |
| U | 4130 | 1.500 | 0.29 | 0.47 | 0.013 | 0.014 | 0.23 | 0.02 | 0.86 | 0.18 | 0.01 | 0.028 | |
| V | 4142 | 0.995 | 0.41 | 0.79 | 0.022 | 0.009 | 0.26 | 0.02 | 1.01 | 0.18 | 0.02 | 0.032 | |
| W | 4142 | 0.998 | 0.43 | 1.04 | 0.011 | 0.034 | 0.23 | 0.04 | 1.01 | 0.17 | 0.04 | 0.033 | |
| X | 1085 | 0.656 | 0.85 | 0.72 | 0.007 | 0.018 | 0.17 | 0.03 | 0.07 | 0.01 | 0.02 | 0.025 | |
| Y | 52100 | 1.063 | 0.98 | 0.42 | 0.010 | 0.025 | 0.22 | 0.08 | 1.42 | 0.03 | 0.04 | 0.024 | |

In the preferred practice of this invention, the steel is in the form of a workpiece which can be heated separately so that the heating process can be precisely controlled. For that purpose, it is frequently preferred to employ workpieces in a form having a repeating cross section such as bars, rods, tubes, and the like.

In accordance with the preferred embodiment, the individual workpieces are rapidly heated by direct electric resistance heating while the temperature of the workpiece is monitored by a suitable sensing device. The rapidity of the heating process, while permitting the economic processing of large quantities of workpieces, causes the austenitizing transformation to proceed very rapidly. The most preferred method for rapid heating in accordance with the present invention is described in detail by Jones et al., in U.S. Pat. No. 3,908,431 (the disclosure of which is incorporated herein by reference) involves a procedure whereby an electrical current is passed through the steel workpiece; the electrical resistance of the workpiece to the flow of electrical current causes rapid heating of the workpiece uniformly throughout its entire cross section.

It is critical in the process of the present invention that the heating of the workpiece to convert the steel to austenite be carried out rapidly, that is, the time that the steel is held above the $A_1$ temperature should be less than five minutes. In the preferred practice of the invention, the austenitization of the steel by direct electrical resistance heating is carried out in a total heating time ranging from 5 to 100 seconds with the time that the steel is above the $A_1$ temperature usually being less than 40 seconds.

In accordance with the practice of this invention, the steel workpiece is first loaded into electrical contacts and securely clamped. Then the electric current is switched on, and the workpiece is rapidly heated to the austenitizing temperature. The temperature is monitored using a standard radiation pyrometer. When the appropriate austenitizing temperature has been reached, the current is switched off and the workpiece is unclamped.

When steel is rapidly heated, as described above, it is necessary to heat the steel to higher temperatures than those which are required for furnace treatment. For example, the alloy 4140 can be fully austenitized in a furnace that is maintained at 1550° F., but the time required to insure full austenitization would be several hours. The same steel can be fully austenitized in less than a minute using direct electric resistance heating, but the steel must be heated to 1700° F. instead of 1550° F. This time-temperature relationship for the austenitization of steel is a direct result of the dependence of the diffusion of carbon on both time and temperature. It is a phenomenon which is well known to those skilled in the art.

After the workpiece has been fully austenitized at an appropriate austenitizing temperature, it is removed from the heating station and immediately loaded into a quenching fixture. There it is rapidly cooled to a temperature near that of the quenching bath, and a predominantly martensitic structure forms in the steel. The hardened workpiece is then loaded onto a holding table.

In accordance with the preferred practice of this invention, use is made of a severe quenching medium. Quenching media conventionally are rated by a factor which is called the severity of quench or the "H coefficient". The severity of quench is a function of both the composition of the quenching medium and the degree of agitation. For example, the H coefficient for still oil is approximately 0.25, while violently agitated oil has an H coefficient near 1.0. Still water has an H coefficient near 1.0, and agitated water can have H coefficients greater than 1.0 depending upon the degree of agitation. The preferred practice of this invention includes the use of a quenching process which achieves H coefficients greater than 1.2 while insuring the uniform cooling of the workpiece. Use is made of an aqueous quenching medium which can be water or water-containing various conventional quench additives. Some degree of agitation is desirable to insure that the part is uniformly quenched.

When the entire load of workpieces has been austenitized and quenched, the workpieces are loaded on the entrance table for tempering. During the tempering opertion, the workpieces are individually loaded into the heating station, held in tension (at a tension level below the yield stress of the steel), and heated to an appropriate tempering temperature. The combination of heating and tension causes the workpiece to straighten. A schematic illustration of the equipment used for processing in accordance with the concepts of this invention is shown in FIG. 1.

The illustration shown in FIG. 1 represents the actual laboratory equipment configuration used to process most of the steels shown in Table 1. Other equipment configurations could be used to process steel in accordance with the concepts of this invention, and this particular configuration is presented only as an example. This configuration was designed for bars, rods, or tubes which range in length from 8 feet to 14 feet and range in diameter from $\frac{1}{2}$ inch to $3\frac{1}{2}$ inches.

Figure 2:
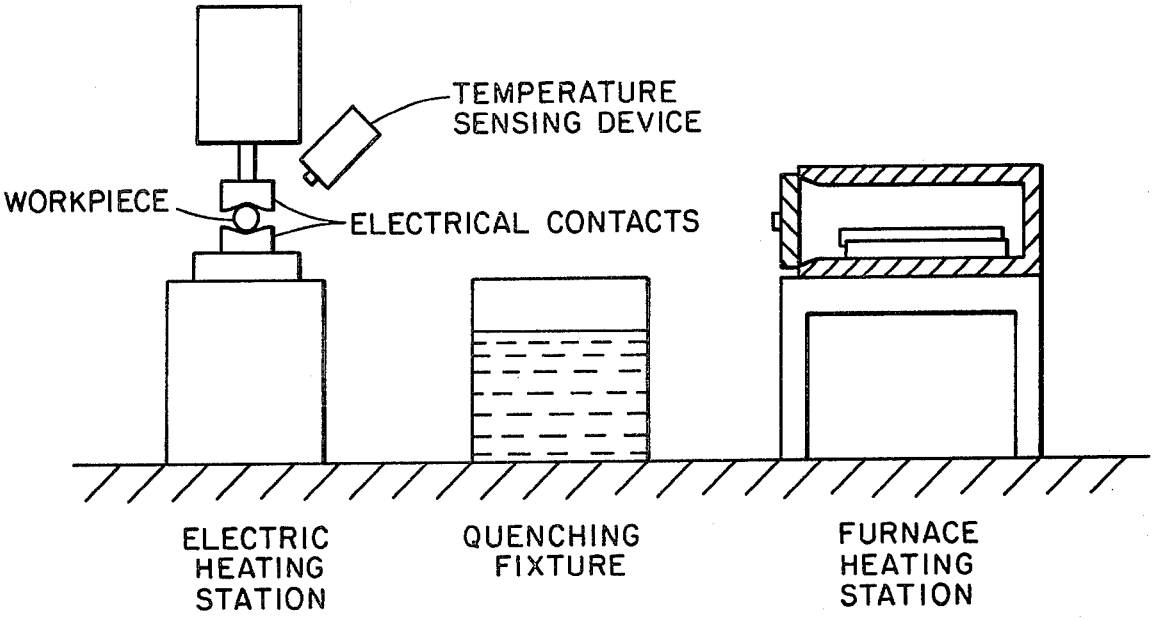
FIG. 2 is a schematic illustration of the equipment used for treating small workpieces specifically to compare heat treating in accordance with the concepts of this invention and by conventional means.

FIG. 2 is a schematic illustration showing an equipment configuration used specifically for processing of smaller steel workpieces in accordance with the concepts of this invention and in a conventional manner for comparison purposes.

As was explained above, when rapid heating is used to austenitize steel, there is very little time for various elements to diffuse to the austenite grain boundaries. Consequently, the strength of the austenite grain boundaries remains high, and the steel resists cracking during the quenching process. This phenomenon is one of the major benefits of the present process.

Another benefit of processing steel in accordance with the concepts of this invention is that there is a lower level of distortion during quenching when the new process is employed as compared to the level of distortion observed during conventional processing.

An additional benefit of the rapid austenitizing cycle is that there is very little oxide formed on the surface of the workpiece because the steel is at the high temperatures for such a short period of time. Oxide formation can be avoided in furnace treatments through the use of a protective atmosphere, but the generation of a protective atmosphere is expensive. The present process avoids the formation of a significant amount of oxide on the steel workpieces and thereby provides for savings in steel weight loss, steel cleansing costs, or in protective atmosphere costs.

Another benefit of processing in accordance with the concepts of this invention is the reduction in the amount of decarburization which occurs during heat treatment. When steel is treated in accordance with this invention, the austenitizing cycle is very short, and there is very little time for carbon to react with air and leave the steel. Consequently, a decarburization layer does not form on the steel. This aspect of the present process makes it possible to process workpieces which have been turned or ground to remove decarburization without fear of decarburizing the surface of the workpiece. Consequently, the surface of the steel workpiece can be turned or ground in the hot rolled or annealed condition prior to heat treatment. In conventional processing, the steel must be turned or ground after heat treatment, when the steel is in a hardened condition.

Yet another benefit of processing in accordance with the concepts of this invention pertains to the alloys used for a given heat treated product requirement. As explained earlier, quench cracking and quench distortion which occur during the conventional processing of steel are major problems. To minimize these problems, a milder quenching medium is usually employed. The penalty for using a milder quench is that the full hardening potential of the steel cannot be realized. As a consequence of processing in accordance with the concepts of this invention, a severe quenching medium can be employed and the full hardening potential for a given alloy can be realized.

Another beneficial feature of the present invention is associated with the reduction of quenching distortion during the tempering step of the processing. This aspect of the process was previously mentioned, and it is believed that this temper straightening phenomenon is caused by the preferential redistribution of residual stresses in the workpiece. Tests have shown that the stress required to cause temper straightening to occur is far below the yield stress of the steel. Consequently, the phenomenon is different from stretcher straightening and other mechanical straightening processes which require the generation of stresses higher than the yield strength of the steel.

An important benefit of the present invention is that it is highly energy efficient. Unlike conventional furnace treating operations in which large furnaces must be heated to elevated temperatures, essentially only the workpiece being processed is heated in the present invention. In fact, studies have shown that the present invention has an efficiency of 70 to 90% compared to a maximum efficiency of only about 35% for a conventional furnace with recuperators.

It is obvious that the present invention offers several important advantages to the manufacturer of heat treated steel workpieces. The problem of quench cracking is virtually eliminated by the present process. Quenching distortion is minimized and the formation of oxide during processing is minimized. The full hardening potential of steel can be realized by employing the present process because a severe quench is employed. Furthermore, any distortion which does occur in the steel during austenitizing and quenching can be significantly reduced during the tempering step. It was also discovered that the steel produced in accordance with the concepts of this invention has superior uniformity as compared to steel processed by conventional techniques. Improvements in ductility, toughness, and fatigue strength have also been noted.

Having described the basic concepts of the present invention, reference is now made to the following examples, which are provided by way of illustration and not by way of limitation of the practice of the present invention.

EXAMPLE 1

This example is a comprehensive comparison of conventional furnace treatment and heat treatment in accordance with the concepts of this invention. In this example, in order to demonstrate that the concepts of this invention virtually eliminate quench cracking, bars are subjected to austenitization followed by quenching, without including the tempering step since the latter has essentially no effect on quench cracking.

The chemical analysis of the heat of steel used for this comparison test is shown in Table 1-Heat A. 4150 steel was used for this comprison because steels with carbon levels above 0.40% carbon are prone to quench cracking. This heat also contains Te which is a machinability additive. In general, machinability additives such as Te, Se, S and Pb enhance the possibility of quench cracking. These additives form inclusions in the steel, and the inclusions act as initiation points for the quench cracks. The fixtures illustrated in FIG. 2 were used for this comparison test.

Specimens for this comparison test were made from hot rolled bars of 4150 steel which had been mechanically cleaned to remove the oxide which formed on the steel during hot rolling. Ten hot rolled bars were randomly selected, and two short specimens were cut from each of these bars. Each specimen was 21 inches long and 1.026 inches in diameter. The twenty specimens were divided into two groups of ten. One group was designated for furnace treatment and the other was designated for processing in accordance with the concepts of this invention.

The specimens designated for furnace treatment were heated in the laboratory furnace to a temperature of 1550° F. In this case, a four-hour furnace treatment was required to insure that the entire furnace load had reached the austenitizing temperature. Then each specimen was individually quenched in agitated water. No additives were used in the quenching bath, and the bath temperature was maintained at 80° F.

Then the other group of specimens were processed using direct electric resistance heating. Each specimen was heated to 1700° F. and quenched in the same quench tank used for the furnace treated specimens. it required only 16 seconds to heat each specimen to the desired austenitizing temperature. It should be noted that the austenitizing temperature used for the electricl treatment was 150 ° F. higher than the austenitizing temperature used for the furnace treatment. A higher austenitizing temperature was necessary for the electricl treatment to insure that the steel had been fully austenitized during this short heating cycle. In general, higher austenitizing temperatures tend to promote quench cracking, and the use of a higher austenitizing temperature in this comparison test actually biased the test in favor of the furnace treatment.

After quenching of both groups of specimens had been completed, each specimen was inspected for quench cracks and measured to determine straightness. Quench cracks were easily identified on the furnace treated specimens, and visual inspection revealed no quench cracks in the electrically treated specimens. To make sure that there were no quench cracks on the electrically treated specimens, these specimens were more closely examined using dye penetrant techniques. Once again, no quench cracks were found.

Figure 3A:
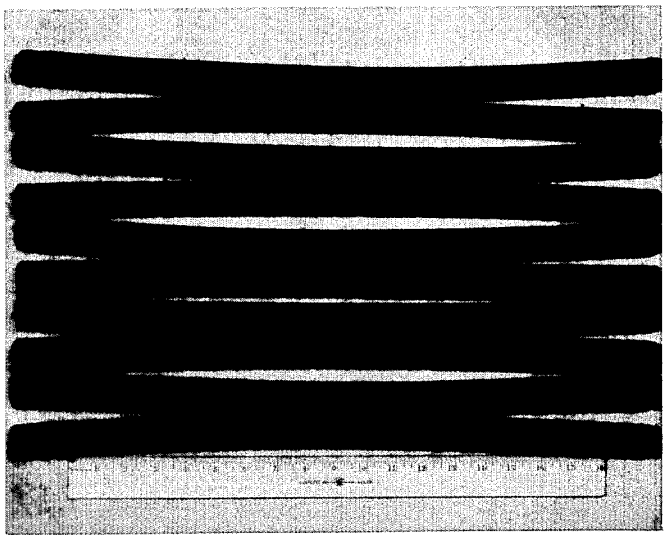
FIG. 3A is a photograph showing furnace treated workpieces of 4150 steel in the as-quenched condition.
Figure 3B:
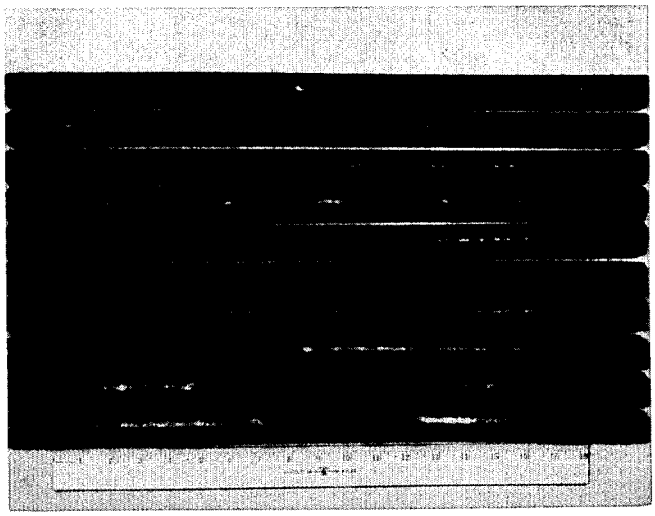
FIG. 3B is a photograph showing workpieces of 4150 steel in the as-quenched condition which have been treated in accordance with the concepts of this invention.

Each specimen was also measured to determine straightness. This was done by placing the specimen on a flat surface, pushing the specimen against a straight steel bar which had also been placed on the flat surface, and then measuring the maximum separation between the straight bar and the specimen. This measurement (in inches) was divided by the length of the specimen (in feet) to yield a quantitative indication of the degree of distortion in each specimen. The two groups of specimens were also photographed, and FIGS. 3A and 3B show that the electrically treated bars were much straighter than the furnace treated bars. Table 2 presents the data pertaining to these two groups of heat treated bars.

TABLE 2

COMPARISON TEST FOR 4150

| Specimen Number | Degree of Distortion (in/ft) | Quench Cracks |
|---|---|---|
| Furnace | | |
| F-1 | 0.191 | 0 |
| F-2 | 0.114 | 1 |
| F-3 | 0.046 | 0 |
| F-4 | 0.171 | 0 |
| F-5 | 0.171 | 1 |
| F-6 | 0.143 | 1 |
| F-7 | 0.107 | 0 |
| F-8 | 0.191 | 1 |
| F-9 | 0.223 | 1 |
| F-10 | 0.129 | 0 |
| Average Distortion | 0.149 | 50% Quench Cracked |
| Electric | | |
| E-1 | 0.040 | 0 |
| E-2 | 0.039 | 0 |
| E-3 | 0.046 | 0 |
| E-4 | 0.039 | 0 |
| E-5 | 0.014 | 0 |
| E-6 | 0.038 | 0 |
| E-7 | 0.036 | 0 |
| E-8 | 0.031 | 0 |
| E-9 | 0.062 | 0 |
| E-10 | 0.041 | 0 |
| Average Distortion | 0.039 | 0% Quench Cracked |

It is evident from the data presented in Table 2 and the photographs in FIGS. 3A and 3B that the steel austenitized in accordance with the concepts of this invention had less quenching distortion than the steel treated in the furnace. In fact, the distortion in the furnace treated specimens was over three times that of the electrically treated bars. It might be assumed that the lower distortion in the electrically treated specimens was due to some difference in the as-quenched hardness achieved in these specimens. However, this was not the case. Table 3 shows a summary of hardness data taken on the cross section of slugs cut from these two groups of as-quenched specimens. These data clearly demonstrate that the same hardness level was achieved in the two groups of specimens. The slight differences shown are within the accuracy of the Rc hardness test:

TABLE 3

HARDNESS COMPARISON FOR 4150 STEEL

| | Furnace Treated | Electrically Treated |
|---|---|---|
| Average Center Hardness | 62.2 Rc | 62.1 Rc |
| Average Mid-Radius Hardness | 60.8 Rc | 61.3 Rc |
| Average Surface Hardness | 60.7 Rc | 61.4 Rc |
| Overall Average Hardness (30 Tests) | 61.2 Rc | 61.6 Rc |

The most significant aspect of the data presented in Table 2 is the quench cracking results. Fifty percent of the furnace treated specimens cracked during the water quench, and this frequency of quench cracking is more or less normal. Usually 4150 steel is quenched in oil to avoid quench cracking. Consequently, one would expect quench cracking to occur if water were used instead of oil for this grade. However, none of the electrically heated specimens cracked even though they were quenched in exactly the same quenching medium and the same as-quenched hardness was achieved in the steel. It it believed that the reason for this difference in the occurrence of quench cracking can be attributed to the rapid austenitizing cycle. There was simply not enough time for harmful elements to segregate at austenite grain boundaries during the short austenitizing cycle employed. Consequently, the grain boundaries remained strong and the specimens resisted quench cracking. On the other hand, there was plenty of time for segregation to austenite grain boundaries in the furnace treated specimens, and 50% of these specimens cracked.

Figure 4A:
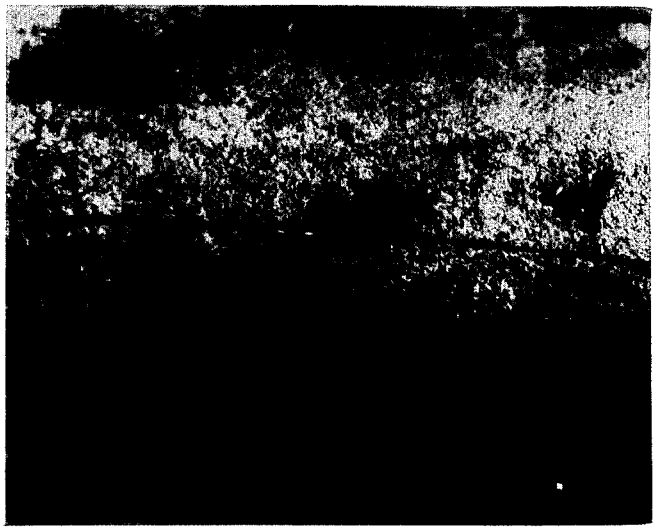
FIG. 4A is a photograph of the surface of one of the workpieces shown in FIG. 3A at a magnification of 4X.
Figure 4B:
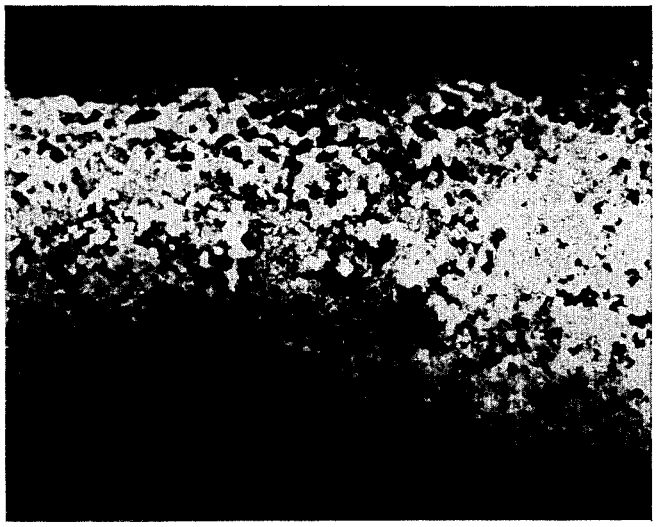
FIG. 4B is a photograph of the surface of one of the workpieces shown in FIG. 3B at a magnification of 4X.

FIGS. 4A and 4B show a comparison of the surface of one of the furnace treated specimens and that of one of the electrically treated specimens. A quench crack is shown in the furnace treated specimen. In general, the quench cracks extended the entire length of the specimens, and they followed an irregular path from end to end. A section cut through one of the specimens revealed that the quench crack extended from the surface to approximately the center of the cross section. Examination of the fracture revealed that it was indeed intergranular in nature. Since no quench cracks were found in the electrically treated specimens, none could be photographed or examined metallographically.

The photographs in FIGS. 4A and 4B illustrate another important aspect of processing steel with rapid austenitizing treatments. FIG. 4A shows that the surface of the furnace treated steel has on it a thick layer of oxide. On the other hand, the specimen which was electrically austenitized has on it only a thin layer of scale. Measurements of the thickness of the oxide on the furnace treated bars revealed that this layer varied in thickness from 0.0015" to 0.0035". An attempt was made to measure the thickness of the oxide layer on the electrically treated specimens, but the layer was so thin that measurements could not be made. All that could be said about the electrically treated specimens is that the oxide layer was less than 0.0001" in thickness. This lack of an oxide layer on the steel treated in accordance with the concepts of this invention is another obvious advantage of this process.

EXAMPLE 2

In this example, the tests and examinations that were conducted in Example 1 were repeated, but a different grade of steel was used.

Ten hot rolled bars of 6150 steel from Heat B were selected at random. These ten bars were mechanically cleaned and then twenty specimens were cut from them. These specimens were 21 inches in length and 1.066 inches in diameter. The chemical analysis of Heat B is given in Table 1, and 6150 was selected for this series of tests because it was felt that this grade would be prone to quench crack when water quenched. The fixtures described in FIG. 2 were used to heat treat these twenty specimens.

Ten of the specimens were furnace treated using an austenitizing temperature of 1550° F. and a heating time of four hours. After austenitizing, the specimens were individually quenched in agitated water, inspected for quench cracks, and measured for straightness.

Figure 5A:
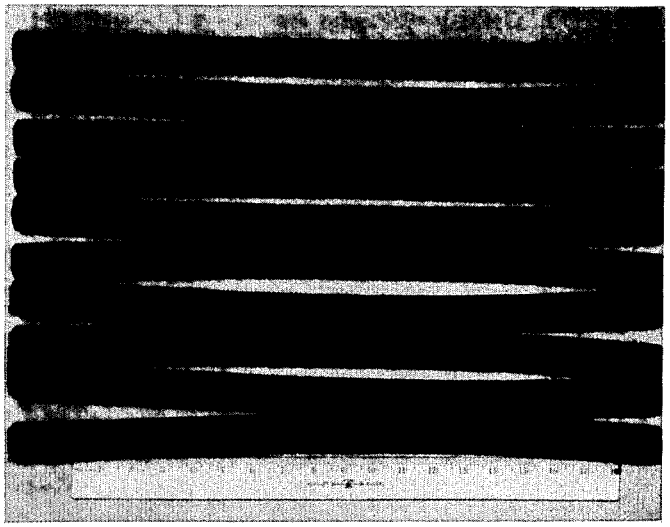
FIG. 5A is a photograph showing furnace treated workpieces of 6150 steel in the as-quenched condition.
Figure 5B:
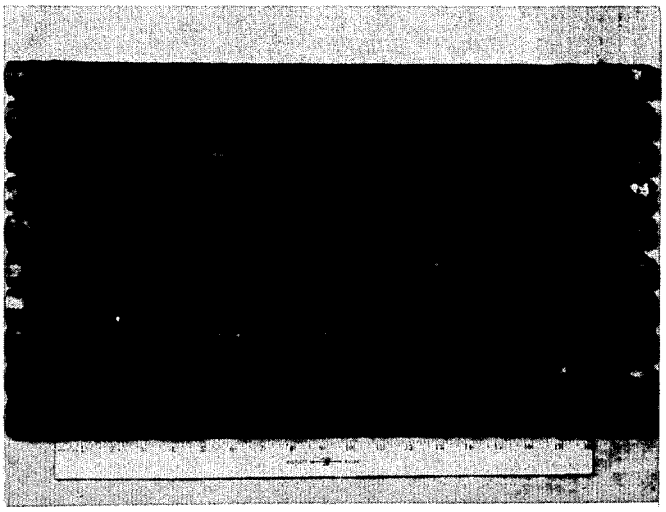
FIG. 5B is a photograph showing workpieces of 6150 steel in the as-quenched condition which have been treated in accordance with the concepts of this invention.

Then the ten remaining specimens were austenitized in accordance with the concepts of this invention. The austenitizing temperature selected was 1700° F., and the time required to heat each specimen was 18 seconds. The specimens were individually quenched in the same bath that was used for the furnace specimens. The procedures described in Example 1 were again used to analyze these specimens, and the results of these tests are shown in Table 4. Photographs of the as-quenched specimens are shown in FIGS. 5A and 5B.

TABLE 4

COMPARISON TEST FOR 6150

| | Specimen Identification | Degree of Distortion (in/ft) | Quench Cracks |
|---|---|---|---|
| Furnace: | F-1 | 0.137 | 0 |
| | F-2 | 0.092 | 1 |
| | F-3 | 0.191 | 1 |
| | F-4 | 0.192 | 1 |
| | F-5 | 0.153 | 2 |
| | F-6 | 0.114 | 0 |
| | F-7 | 0.140 | 1 |
| | F-8 | 0.086 | 1 |
| | F-9 | 0.000 | 1 |
| | F-10 | 0.046 | 1 |
| | Average Distortion | 0.115 | 80% Cracked |
| Electric: | E-1 | 0.017 | 0 |
| | E-2 | 0.017 | 0 |
| | E-3 | 0.000 | 0 |
| | E-4 | 0.014 | 0 |
| | E-5 | 0.036 | 0 |
| | E-6 | 0.022 | 0 |
| | E-7 | 0.003 | 0 |
| | E-8 | 0.019 | 0 |
| | E-9 | 0.031 | 0 |
| | E-10 | 0.020 | 0 |
| | Average Distortion | 0.018 | 0% Cracked |

The data presented in Table 4 and the photographs in FIGS. 5A and 5B illustrate that rapid austenitization tends to lower the level of quenching distortion. In this case, the degree of distortion for the furnace treated specimens were six times that of the electrically treated specimens.

Hardness tests were conducted on the cross section of samples cut from specimens representing both furnace and electrically processed steel, and the results of these hardness tests are shown in Table 5. The data in Table 5 indicate that the two groups of specimens were quenched to essentially the same hardness level. Consequently, the differences observed in the degree of quenching distortion, and the difference in the frequency of quench cracking, cannot be attributed to differences in the degree of martensitic transformation.

TABLE 5

HARDNESS COMPARISON FOR 6150 STEEL

| | Furnace Treated | Electrically Treated |
|---|---|---|
| Average Center Hardness | 61.1 Rc | 61.5 Rc |
| Average Mid-Radius Hardness | 60.8 Rc | 61.1 Rc |
| Average Surface Hardness | 61.0 Rc | 61.5 Rc |
| Overall Average Hardness (30 tests) | 60.9 Rc | 61.5 Rc |

The most significant aspect of the data presented in Table 4 pertains to the quench cracking comparison. Eighty percent of the furnace treated specimens cracked while none of the electrically treated specimens cracked. These data clearly demonstrate that rapid austenitizing avoids the problem of quench cracking.

Figure 6A:
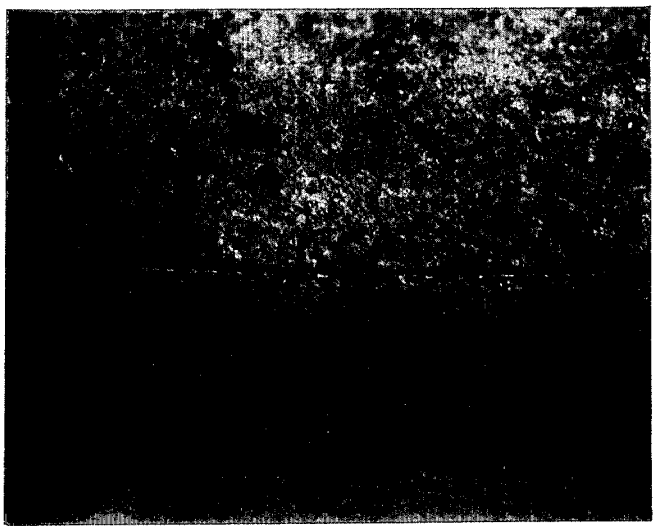
FIG. 6A is a photograph of the surface of one of the workpieces shown in FIG. 5A at a magnification of 4X.
Figure 6B:
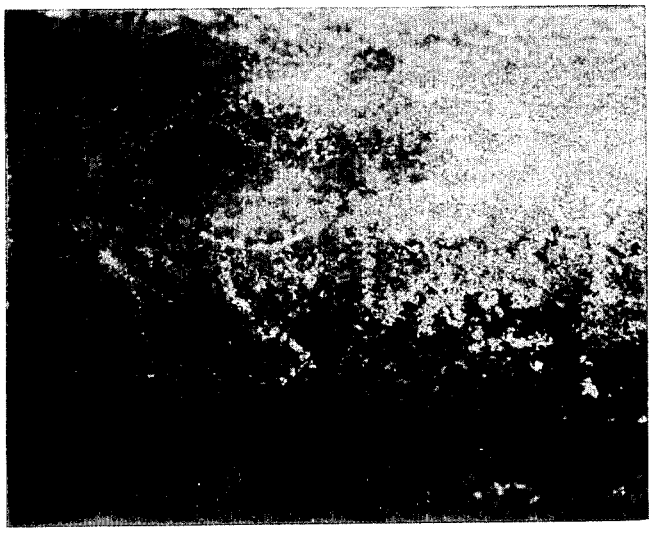
FIG. 6B is a photograph of the surface of one of the workpieces shown in FIG. 5B at a magnification of 4X.

FIGS. 6A and 6B show the surface of one of the furnace treated specimens and the surface of one of the electrically treated specimens. A quuench crack is clearly shown on the furnace treated specimen. These photographs also show the thick layer of oxide on the furnace treated specimen and the relatively thin layer of oxide on the electrically treated specimen. The oxide layer thickness on these samples was assumed to be similar to that of the corresponding specimens in Example 1.

The results of this series of tests confirm the observations made in Example 1. Rapid austenitization in accordance with the concepts of this invention prevents quench cracking, minimizes quenching distortion, and minimizes the formation of oxide on the steel. Comparison tests of this type have also been conducted on some of the other grades listed in Table 1 which have carbon contents greater than 0.40%. In each case, the results were similar, and the new process prevented quench cracking from occurring.

EXAMPLE 3

This example provides additional evidence of the lack of quench cracking associated with the present process, and describes the range of commercial product that can be made from 414X steels.

Hot rolled bars from ten heats of commercially produced 414X steel were selected for processing and the chemical analyses of these ten heats are given in Table 1-Heats C through L. The 414X alloy series was selected for this test because it is the most popular commercial alloy for heat treatment. Many of the heats selected contained machinability additives which would tend to promote quench cracking of the steel. The bar diameters tested ranged from 0.539 inches to 3.500 inches, and the bars were a minimum of eight feet in length.

The fixture shown in FIG. 1 was used to process several bars from each heat of steel. The bars were loaded into the heating station, heated to 1700° F. and then quenched. After quenching, the bars were mechanically removed from the quench tank and loaded on the exit holding table. When an entire lot of steel had been austenitized and quenched, the bars were returned to the input table and then individually heated to various tempering temperatures. Tempering temperatures between 900° F. and 1350° F. were tested. The largest bars treated were 3.5 inches in diameter and ten feet in length, and these bars required a total of eight minutes to austenitize. All the other bars processed from these ten heats were austenitized in less than eight minutes. Tempering times ranged from a matter of a few seconds to about five minutes.

Figure 7:
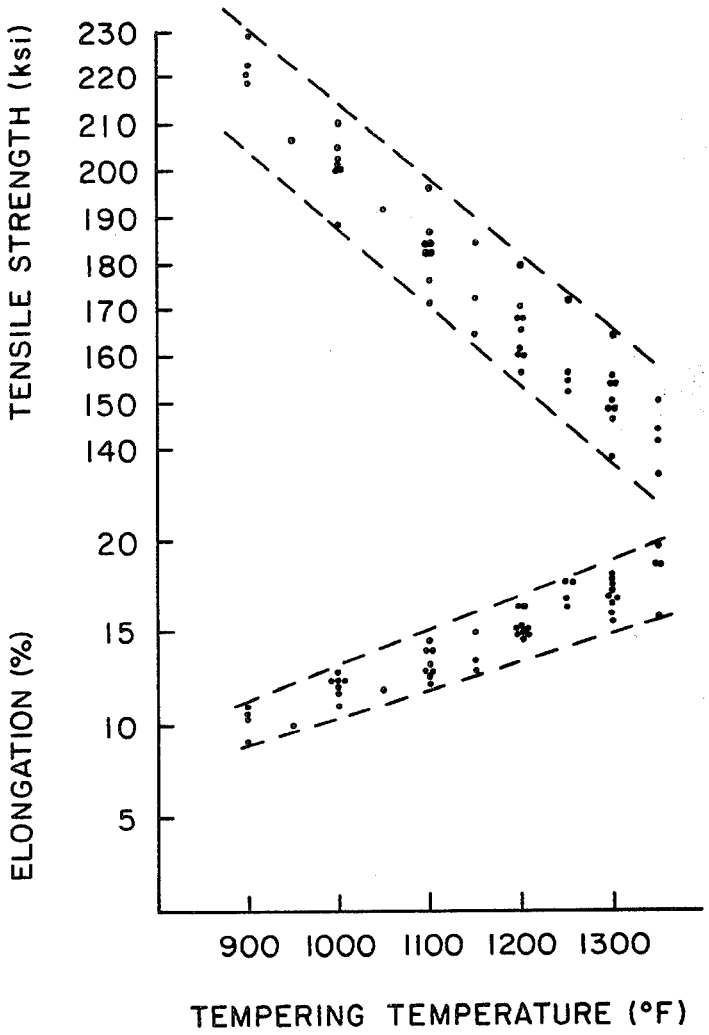
FIG. 7 is a graph of tensile strength and elongation versus tempering temperature with data from ten heats of steel plotted. This graph shows the typical heat-to-heat scatter in mechanical properties which results from processing in accordance with the concepts of this invention.

Extensive testing was carried out on the bars from these ten heats of steel so that the range of mechanical properties could be properly characterized. FIG. 7 shows the strength and ductility data that were developed. Each plotted data point represents the tensile strength of an individual bar from one of these ten heats. In all, fifty bars were processed. The dashed lines serve to outline the range of the mechanical properties, and they do not represent any statistical feature of the data.

The ranges shown in FIG. 7 are surprisingly narrow considering that the diameters of these bars ranged from 0.593 inches to 3.500 inches. This narrow band of mechanical properties implies that the new process is not sensitive to minor changes in the chemistry of the steel or to changes in the diameter. It is also apparent from FIG. 7 that the mechanical properties of the heat treated steel can be easily varied over a wide range by simply controlling the tempering temperature.

Each bar that was processed was also inspected for quench cracks, and no quench cracks were found. This is particularly noteworthy because large diameter bars of 414X steel are usually quenched in oil to avoid quench cracking. Furthermore, all of the large diameter bars tested (Heats J, K, and L) were made from steel which contained machinability additives. As it was mentioned earlier, machinability additives tend to promote quench cracking. These data clearly demonstrate that processing in accordance with the concepts of this invention can be used on a large scale to process commercial steels without the losses that would normally occur due to quench cracking.

EXAMPLE 4

Example 3 demonstrated that the present process could be used for the heat treatment of 414X alloys over a wide range of diameters. It also demonstrated that quench cracking could be avoided through the use of the present process, and it illustrated the range of mechanical properties which could be achieved in that alloy series. This example deals with a wider range of alloy compositions, and it demonstrates the versatility of the present process as well as the lack of quench cracking in other alloys.

The fixtures described in FIG. 1 were used for the processing of steel for this example. All the bars processed were a minimum of eight feet in length, and the processing methods described in Example 3 were used. Austenitizing temperatures ranged from 1600° F. to 1700° F., and tempering temperatures ranged from 900° F. to 1300° F. Table 1 gives the diameters and the chemical compositions of the steels tested in this example, and the following heats were tested: A, B, M, N, O, P, Q, R, S, and T.

Figure 8:
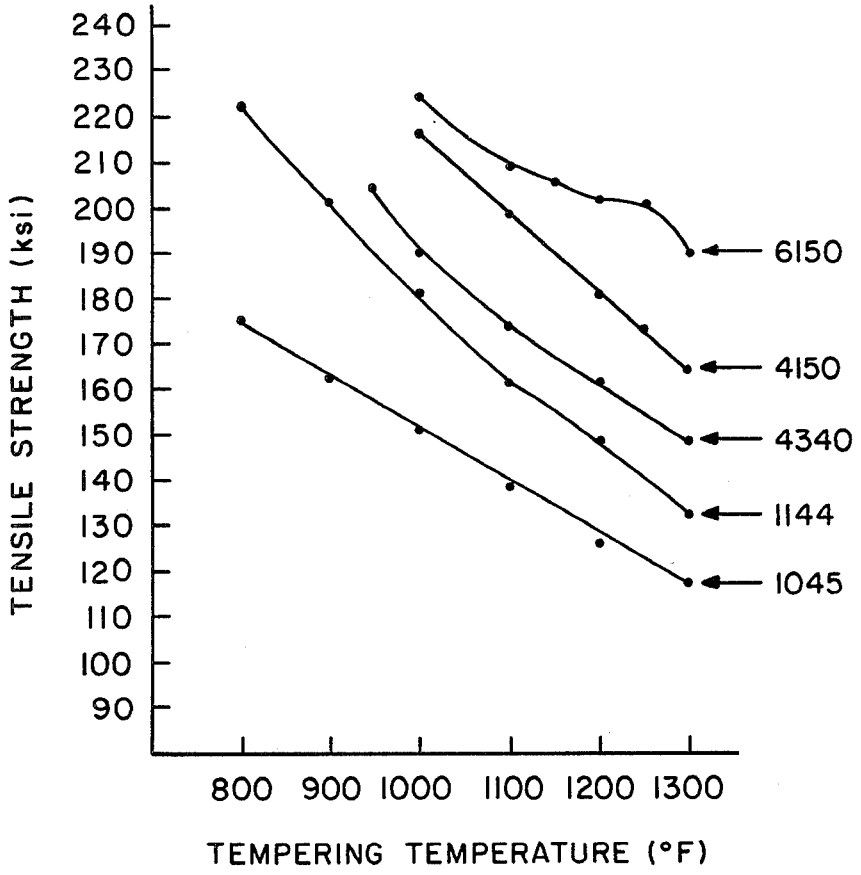
FIG. 8 is a graph of tensile strength versus tempering temperature for a variety of medium carbon steels which have been processed in accordance with the concepts of this invention. The versatility of the present invention is demonstrated by this graph.

Several bars from each of these heats were treated in accordance with the concepts of this invention, and data on the mechanical properties of each bar were developed. FIGS. 8 and 9 show the tensile strength data plotted versus the tempering temperatures for these ten heats of steel. All of the steels behaved in a predictable manner consistent with their alloy content. The nature of the curve for the 6150 steel is somewhat different from the other grades because this steel contains vanadium, and vanadium aging is occurring in this steel at tempering temperatures near 1200° F. This phenomenon is common in vanadium-containing steels, and it does not represent a unique aspect of this invention.

After each bar from these ten heats was heat treated, it was inspected for quench cracks, and none were found. However, it should be noted that steels with carbon contents below 0.40% carbon would not be expected to crack during a water quench. In this example, there were three alloys which feel into this category. The other seven heats tested would tend to quench crack when water quenched, and the 1144 would have a strong tendency to quench crack due to the high sulfur content in this steel.

During the course of processing these various grades of steel, an attempt was made to determine the ideal austenitizing temperature for a given alloy. Obviously, higher temperatures had to be used when rapid austenitizing was employed to compensate for the short cycle. Experimental results indicated that the austenitizing temperature should be about 200° F. above the $A_3$ temperature for a given steel. It should be noted that this temperature is considerably higher than the recommended temperatures for furnace heat treatment.

This example demonstrates that the new process can be applied to a wide range of steel alloys without difficulty. This example also demonstrates that the present process eliminates the quench cracking problem for a wide range of steel grades, and thus demonstrates the versatility of the present process.

EXAMPLE 5

This example demonstrates that the present process can be used for steel workpieces which are in the shape of tubes.

The apparatus described in FIG. 1 was used to process three tubes made from a commercial heat of 4130. The chemical analysis of this heat (Heat U) is shown in Table 1. The tubes used for this test were 1½ inches in diameter with a wall thickness of ⅜ inches. These tubes were processed through the heat treating fixtures as though they were bars, and no difficulties were encountered. Each tube was austenitized at 1700° F. and tempered at temperatures between 750° F. and 1050° F. After heat treatment, the tubes were tested to determine their mechanical properties. Table 7 shows the results of these tests.

TABLE 7

MECHANICAL PROPERTIES OF HEAT TREATED TUBES

| Processing | Tensile (ksi) | Yield (ksi) | EL (%) | RA (%) |
|---|---|---|---|---|
| All tubes were austenitized at 1700° F. | | | | |
| Tempered at 750° F. | 202.8 | 184.1 | 12.5 | 59.1 |
| Tempered at 900° F. | 184.7 | 174.3 | 13.0 | 62.4 |
| Tempered at 1050° F. | 159.3 | 145.6 | 16.0 | 67.3 |

Each tube was inspected for quench cracks and tested for uniformity. No quench cracks were found, and the uniformity of the steel from surface to the interior and along the length was excellent.

This example demonstrates that the concepts of this invention can be applied to tubes without any difficulties. No modifications of the equipment were necessary, and a uniform high strength tube product resulted from this heat treatment.

EXAMPLE 6

This example demonstrates the phenomenon of temper straightening which was mentioned earlier. Temper straightening can be used to reduce the level of quenching distortion which occurs when long workpieces are heat treated.

Bars from two heats, J and K, of 4142 were processed in accordance with the concepts of this invention. The chemical analyses and diameters of these bars are given in Table 1, and the equipment illustrated in FIG. 1 was used to process these two heats of steel.

Figure 10A:
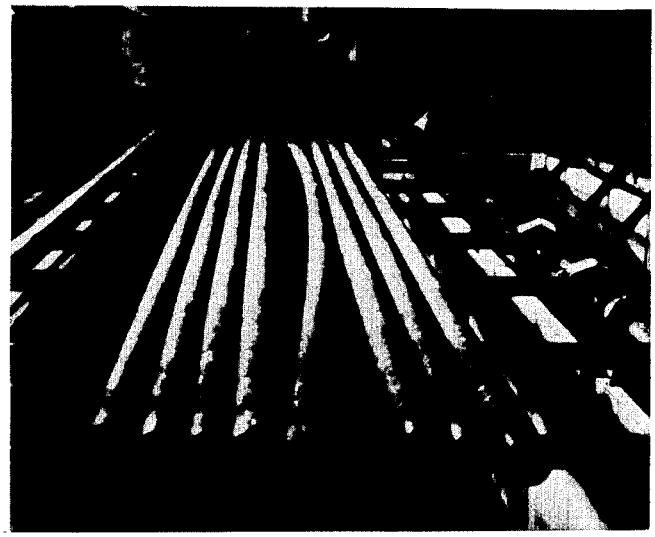
FIG. 10A is a photograph of several long workpieces in the as-quenched condition illustrating severe quenching distortion.
Figure 10B:
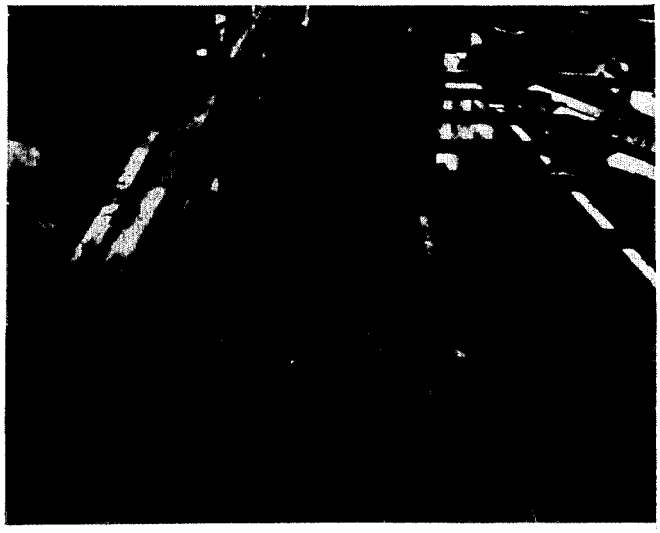
FIG. 10B is a photograph of the same long workpieces shown in FIG. 10A, but now these workpieces have been tempered in accordance with the concepts of this invention. The elimination of quenching distortion is demonstrated.

In this test, the straightness of each bar was measured after quenching, and again after tempering. During tempering, a tension force of 400 lbs. was applied to the steel workpiece through the electrical contacts. This level of tension alone was not sufficient to cause plastic deformation of these large diameter bars. However, during tempering, these bars were observed to straighten to a considerable degree. FIG. 10A shows a photograph of bars from Heat J in the as-quenched condition. It should be noted that the fifth bar in this group was badly distorted during the quench due to a failure in part of the agitation system in the quenching fixture. FIG. 10B shows the same bars after tempering under tension. Note the considerable improvement in the straightness of the bars after tempering. Table 8 shows the measured values of straightness after quenching and after tempering for these bars. The tempering temperatures are also provided.

TABLE 8

DISTORTION IN BARS FROM HEAT J (Bar Length-12'4")

| | Distortion After Quenching (in/ft) | Distortion After Tempering (in/ft) | Tempering Temperature (°F.) |
|---|---|---|---|
| | 0.0355 | 0.0053 | 900 |
| | 0.0558 | 0.0105 | 1000 |
| | 0.0507 | 0.0105 | 1100 |
| | 0.0202 | 0.0053 | 1200 |
| | 0.2584 | 0.0845 | 1300 |
| | 0.0101 | 0.0053 | 1200 |
| | 0.0253 | 0.0053 | 1200 |
| | 0.0101 | 0.0053 | 1200 |
| Average | 0.0582 | 0.0165 | |

This experiment was repeated on larger diameter bars from Heat K. Table 9 shows the results of straightness measurements taken during the processing of this heat.

TABLE 9

DISTORTION IN BARS FROM HEAT K (Bar Length-12'4")

| | Distortion After Quenching (in/ft) | Distortion After Quenching (in/ft) | Tempering Temperature (°F.) |
|---|---|---|---|
| | 0.0304 | 0.0304 | 900 |
| | 0.0912 | 0.0253 | 1000 |
| | 0.2027 | 0.0304 | 1100 |
| | 0.2027 | 0.0355 | 1200 |
| | 0.2230 | 0.0355 | 1300 |
| Average | 0.1500 | 0.0314 | |

The data presented in Tables 8 and 9 illustrate the phenomenon of temper straightening. In both cases, there was a considerable amount of reduction in the distortion of the bars due to the combination of a small tension stress and rapid heating. The tension stress that was applied to these bars was so small that this straightening phenomenon cannot be explained in terms of yielding of the steel. Instead this reduction in the amount of distortion is due to the preferential redistribution of residual stress in the bar. It would not be possible to achieve this straightening effect in a furnace tempering treatment, because the mass of the furnace load would tend to fix the shape of the workpieces and prevent them from straightening.

EXAMPLE 7

This example describes the results of a comprehensive comparison test between conventional heat treatment and heat treatment in accordance with the concepts of this invention. The chemical analysis of the steel used for this comparison test (Heat G) is given in Table 1. It was confirmed that this particular heat of 4140 did not quench crack when furnace austenitized and water quenched. Hence, it was feasible to carry out a comparison test in this particular instance. The equipment described in FIG. 2 was used to prepare specimens for this series of tests.

Furnace treated specimens were austenitized at 1550° F. for one hour, quenched in agitated water, and then tempered for one hour at temperatures between 900° F. and 1100° F. Furnace loads were kept small to insure proper austenitizing and tempering treatments. An equal amount of steel was then processed in accordance with the concepts of this invention using direct electric resistance heating. An austenitizing temperature of 1700° F. was used for all the electrically heated specimens, and tempering temperatures ranged from 1000° F. to 1300° F. Austenitizing times for each specimen were 42 seconds, and tempering times were all under 30 seconds. These treatments produced specimens which ranged in tensile strength from 150 ksi to 210 ksi, and enough specimens were processed at various levels to conduct comparisons of hardness, strength, ductility, fatigue life, and Charpy impact toughness.

Figure 11:
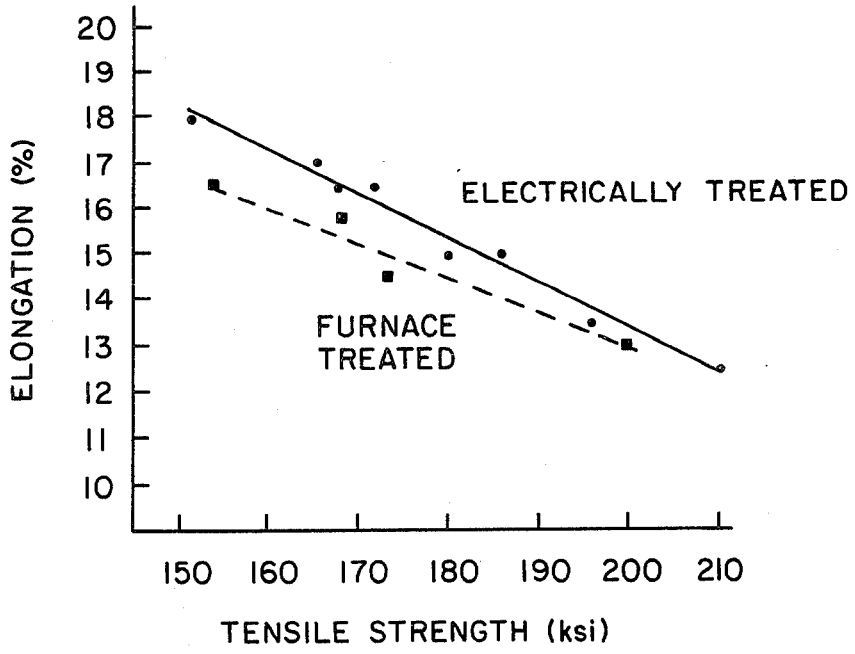
FIG. 11 is a graph of elongation versus tensile strength which illustrates the superior ductility of steel which is processed in accordance with the concepts of this invention.

The results of tensile testing revealed that steel processed in accordance with the present invention had improved ductility as compared to conventionally processed steel. FIG. 11 shows a plot of tensile strength versus elongation for specimens processed by the two techniques. The graph indicates that there is an improvement in ductility associated with the present process. The differences are small in magnitude, but the trend is clearly illustrated. This improvement in ductility is attributed to the refined microstructure which is produced as a result of the rapid austenitizing treatment.

Next, two relatively large volumes of steel bars were prepared to the same strength level using the two processes for fatigue testing. Smooth rotating-bending fatigue specimens were made from these bars and tested to determine the fatigue limit of the steel. Several tensile and hardness specimens were also cut from these bars. Table 10 shows the results of testing of this steel. The improvement in fatigue life and fatigue ratio is clearly illustrated by the data presented in this table.

TABLE 10

THE MECHANICAL PROPERTIES OF FATIGUE SPECIMENS - HEAT G

| Mechanical Properties | Furnace Processed | Electrically Processed |
|---|---|---|
| Tensile Strength (ksi) | 168.2 | 168.1 |
| Yield Strength (ksi) | 156.4 | 155.3 |
| Elongation (%) | 15.8 | 16.5 |
| Reduction of Area (%) | 53.5 | 57.1 |
| Core Hardness (Rc) | 36.4 | 36.8 |
| Fatigue Limit (ksi) | 88.8 | 91.5 |
| Fatigue Ratio | 0.528 | 0.544 |

Fatigue Ratio = Fatigue Limit/Tensile Strength

Charpy impact toughness tests were also conducted on samples from these two lots of steel which were prepared to the same tensile strength level (180 ksi). Table 11 shows the results of Charpy impact testing over a wide range of temperatures. Note that the impact energy was greater for the steel processed in accordance with the present invention regardless of the testing temperature.

TABLE 11

CHARPY IMPACT DATA FOR HEAT G

| Testing Temperature | | Furnace Processed | Electrically Processed |
|---|---|---|---|
| (°C.) | (°F.) | (ft-lbs) | (ft-lbs) |
| 90 | 194 | 42.0 | 58.0 |
| 50 | 122 | 42.0 | 44.0 |
| 24 | 75 | 39.0 | 42.0 |
| 0 | 32 | 36.5 | 40.0 |
| −25 | −13 | 26.5 | 32.0 |
| −40 | −40 | 24.0 | 27.5 |
| −50 | −58 | 19.0 | 20.5 |
| −72 | −98 | 14.5 | 16.5 |

The data presented in this example demonstrated that the steel produced in accordance with the concepts of this invention has superior ductility, fatigue properties, and Charpy impact toughness properties as compared to steel produced using conventional techniques.

EXAMPLE 8

As noted, furnace heating has associated with it certain control problems arising from variation of temperature from the surface to the core of the furnace load. This temperature variation results in a lack of uniformity in the furnace treated product. In order to test this hypothesis, a sample of furnace heat treated 4142 was purchased from a steel service center. Then a similar sample was prepared using the equipment described in FIG. 1 and the concepts of this invention. Both samples consisted of 29 bars of 4142, one inch in diameter and approximately twelve feet in length. The chemical analyses of these two heats (Heats V and W) are given in Table 1.

The steel prepared in accordance with the concepts of this invention was austenitized at 1700° F. and tempered at 1270° F. Then the workpieces were mechanically straightened to commercial tolerances. A tensile specimen and a hardness specimen were cut from each bar and statistical analysis techniques were used to ascertain the uniformity of the steel. The same series of tests and the same analyses were conducted on the conventionally produced steel, and Table 12 shows the results of the statistical analyses on these two lots of steel.

TABLE 12

STATISTICAL ANALYSES OF THE UNIFORMITY OF 4142

| | Furnace Treated | | Electrically Treated | |
|---|---|---|---|---|
| Mechanical Properties | Range | Standard Deviation | Range | Standard Deviation |
| Tensile Strength (ksi) | 23.9 | 4.257 | 10.9 | 2.284 |
| Yield Strength (ksi) | 22.7 | 4.249 | 14.4 | 3.704 |
| Elongation (%) | 5.0 | 1.045 | 3.0 | 1.127 |
| Reduction of Area (%) | 9.6 | 2.216 | 5.6 | 1.344 |
| Core Hardness (Rc) | 6.0 | 1.394 | 3.0 | 0.577 |

The data shown in Table 12 demonstrate that the steel processed in accordance with the concepts of this invention is more uniform than the furnace processed steel. In every mechanical property category, the range of values obtained was greater for the furnace treated product. The differences between the uniformity of these two steels are most prominent when the tensile strength and hardness data are considered. The furnace treated product had twice the range of values as compared to that of the electrically treated steel. The standard deviations in tensile strength for the two steels also indicate that the steel produced in accordance with the concepts of this invention is about twice as uniform. Similarly, the hardness data indicate that the electrically treated product is about twice as uniform as the furnace treated product.

To demonstrate that the process of this invention makes it possible to realize the full potential of the alloy content in steel by being able to make use of a severe quench, a comparison was made between the conventionally produced sample described in Example 8 (Heat V) and a sample of a lower alloy content steel (1045, Heat O), which was treated in accordance with the present invention. Table 13 (Heat O) presents a comparison of the mechanical properties and important alloy content of these two steels. These particular samples were selected for this comparison because they had approximately the same yield strength.

TABLE 13

A COMPARISON OF TWO HEAT TREATED STEELS

| | 4142 Furnace Treated | 1045 Electrically Treated |
|---|---|---|
| Tensile Strength (ksi) | 145.5 | 152.0 |
| Yield Strength (ksi) | 129.4 | 129.8 |
| Elongation (%) | 17.5 | 18.0 |
| Reduction in Area (%) | 60.0 | 62.3 |
| Carbon Content (%) | 0.41 | 0.44 |
| Manganese Content (%) | 0.79 | 0.82 |
| Chromium Content (%) | 1.01 | 0.03 |
| Molybdenum Content (%) | 0.18 | 0.01 |

The data shown in Table 13 illustrate that the full hardening potential of 1045 can be realized to the degree that it matches that of a higher alloy steel which is conventionally processed. In this case, the 1045 actually had a better combination of mechanical properties than the 4142. In the example above, the two steels contain about the same amount of carbon and manganese, but the 4142 contains much more chromium and molybdenum.

EXAMPLE 10

Figure 12A:
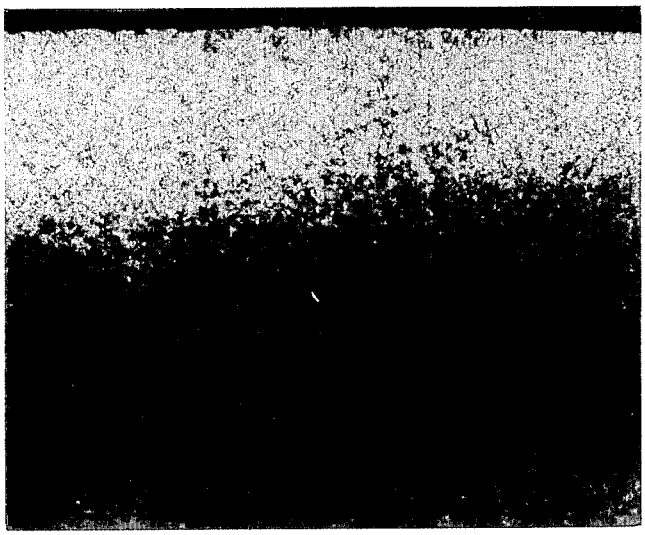
FIG. 12A is a photomicrograph which shows the surface decarburization of a furnace treated specimen.
Figure 12B:
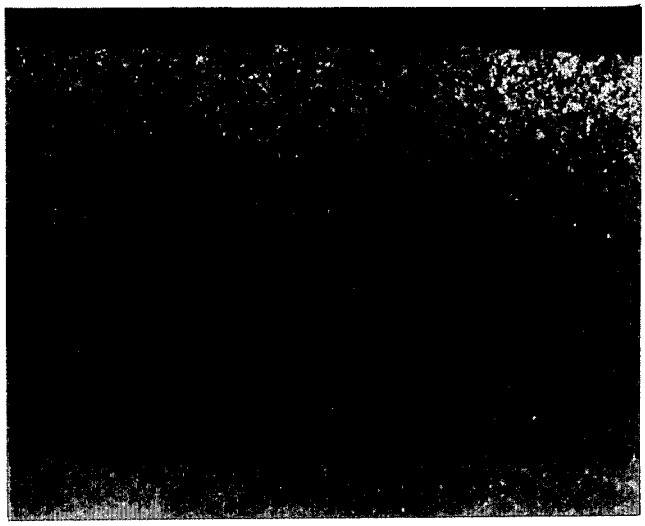
FIG. 12B is a photomicrograph which shows the lack of decarburization of a specimen which was treated in accordance with the concepts of this invention.

This example demonstrates that the process of the invention minimizes the decarburization that occurs during heat treatment. To demonstrate that effect, two metallographic specimens were prepared. The first specimen was taken from Heat V which is a typical sample of furnace treated steel. The second specimen was taken from Heat A which was steel that had been processed in accordance with the concepts of this invention. Both specimens were sectioned so that the decarburized layer near the surface could be easily examined. FIGS. 12A and 12B show the results of metallographic examination.

It is clear from these two figures that the furnace treated steel was badly decarburized, while the steel treated in accordance with the concepts of this invention shows little evidence of decarburization. To verify the metallographic observations, microhardness tests were taken on the prepared cross section of these two specimens. The results of the microhardness tests are shown in FIG. 13. The microhardness tests revealed that there was a slight amount of decarburization associated with the surface of the steel processed in accordance with the concepts of this invention. However, this level of decarburization is relatively minor when compared to the decarburization on the furnace treated specimen.

Based upon these and other observations, it can be concluded that the process of this invention helps to minimize the decarburization of steel during processing. This is most likely a direct result of the very short austenitizing cycle which is employed. There is simply not enough time for a significant amount of decarburization.

It is apparent from these examples that the present invention provides a significant improvement in the process of austenitizing, quenching and tempering of steels. The present process affords improved energy efficiency through the use of direct electric resistance heating. The problem of quench cracking is virtually eliminated, and the problem of quenching distortion is significantly reduced. Furthermore, the quenching distortion that does occur can be corrected in the last step of the process.

Oxidation of the steel surface and decarburization are other common problems which are minimized through the present process. The process of this invention also makes it possible to realize the full hardening potential of steel. Finally, the product which results from the use of this invention has superior uniformity as compared to the product produced using conventional techniques, and improved ductility, toughness, and fatigue strength.

It will be understood that various changes and modifications can be made in the procedure of carrying out the present invention without departing from the spirit of the invention, especially as defined in the following claims.

I claim:

1. A method for heat-treating a steel workpiece which substantially eliminates quench cracking and quench distortion, which method comprises (a) affixing suitable electrical contacts to opposite ends of a single steel workpiece of finite length and uniform cross section that is susceptible to quench cracking and quench distortion when austenitized in a conventional furnace and severely quenched, (b) rapidly electrically heating the entire workpiece to an austenitizing temperature above the $A_3$ temperature for said steel such that the heating time required between the $A_1$ and the austenitizing temperature is less than 100 seconds, (c) immediately quenching the entire austenitized workpiece in a liquid quenching medium having a severity of quench factor equal to or greater than that of unagitated water to form a predominantly martensitic microstructure, and (d) tempering said hardened workpiece by rapidly electrically heating the entire workpiece to a temperature below the $A_1$ temperature for said steel while maintaining said workpiece in tension at a load level below the yield strength of the steel.

2. A method in accordance with claim 1 wherein the total heating time is between about 5 and about 100 seconds.

3. A method in accordance with claim 1 wherein the heating time between the $A_1$ and the austenitizing temperature is less than about 40 seconds.

4. A process as defined in claim 1 wherein the steel is rapidly heated to a temperature above the $A_3$ temperature by direct electric resistance heating.

5. A process as defined in claim 4 wherein the steel is heated in tempering by direct electric resistance heating.

6. A process as defined in claim 5 wherein the workpiece is in the form of a steel having a repeating cross section.

7. A process as defined in claim 5 wherein the workpiece is quenched under conditions providing a severity-of-quench coefficient greater than 1.2.

* * * * *